US007485030B2

(12) United States Patent
Jespersen

(10) Patent No.: US 7,485,030 B2
(45) Date of Patent: Feb. 3, 2009

(54) GRINDING ELEMENT FOR MOUNTING IN A GROOVE

(76) Inventor: Poul Erik Jespersen, Lyngvaenget 6, Glyngøre, DK-7870 Roslev (DK)

( * ) Notice: Subject to any disclaimer, the term of this patent is extended or adjusted under 35 U.S.C. 154(b) by 0 days.

(21) Appl. No.: 10/558,022

(22) PCT Filed: May 18, 2004

(86) PCT No.: PCT/DK2004/000346

§ 371 (c)(1),
(2), (4) Date: Dec. 22, 2005

(87) PCT Pub. No.: WO2004/103642

PCT Pub. Date: Dec. 2, 2004

(65) Prior Publication Data

US 2006/0281396 A1 Dec. 14, 2006

(30) Foreign Application Priority Data

May 23, 2003 (DK) ..... 2003 00786

(51) Int. Cl.
*B24B 29/00* (2006.01)

(52) U.S. Cl. ..... 451/496; 451/469

(58) Field of Classification Search ..... 451/484, 451/469, 468, 467, 466, 465, 464, 463, 499
See application file for complete search history.

(56) References Cited

U.S. PATENT DOCUMENTS

| | | | | | |
|---|---|---|---|---|---|
| 2,804,730 | A | * | 9/1957 | Block | 451/469 |
| 3,058,269 | A | * | 10/1962 | Block | 451/469 |
| 3,645,049 | A | * | 2/1972 | Freerks et al. | 451/469 |
| 4,835,913 | A | * | 6/1989 | Blanton | 451/468 |
| 5,623,741 | A | | 4/1997 | Clark | |
| 6,217,431 | B1 | | 4/2001 | Brinkmann | |

FOREIGN PATENT DOCUMENTS

| | | | | |
|---|---|---|---|---|
| DE | 1008478 | * | 5/1957 | 451/466 |
| WO | WO01/76824 | | 10/2001 | |
| WO | WO03/095148 | | 11/2003 | |

* cited by examiner

*Primary Examiner*—Robert Rose
(74) *Attorney, Agent, or Firm*—James Creighton Wray

(57) ABSTRACT

The present invention relates to a grinding element for mounting in a recess (41) in a surface of a cylindric drum (42) and including a retainer means (2) designed with outer sidewalls that are complementary to sidewalls of the recess (41), where a squeezing force (F) on the sidewalls of the retainer means (2) arises in a situation of use by rotation of the cylindric drum (42), where the retainer means (2) includes at least one groove (5) for securing a grinding means (1), the groove (5) extending from an outwards facing side of the retainer means (2) and inwards and forming at least one elastic, pliable flap which is disposed between the said groove (5) and at least one of the outer sidewalls wherein the grinding means (1) for accommodation in the groove (5) in the retainer means (2) comprises a mounting means (3) having a socket section (**3*b*) with a shape complementary to the groove (5) in the retainer means (2**).

10 Claims, 2 Drawing Sheets

GRINDING ELEMENT FOR MOUNTING IN A GROOVE

FIELD OF APPLICATION OF THE INVENTION

The present invention concerns a grinding element for mounting in a recess in a surface of a cylindric drum and including a retainer means designed with outer sidewalls that are complementary to sidewalls of the recess, where a squeezing force on the sidewalls of the retainer means arises in a situation of use by rotation of the cylindric drum, where the retainer means includes at least one groove for securing a grinding means, the groove extending from an outwards facing side of the retainer means and inwards and forming at least one elastic, pliable flap which is disposed between the said groove and at least one of the outer sidewalls.

BACKGROUND OF THE INVENTION

By surface treatment, as e.g. grinding or polishing, of diverse elements, grinding and polishing tools are used, provided with a cylindric drum in which is mounted a number of grinding elements that include abrasive paper and support brushes and/or retainer brushes.

These grinding elements are typically made of a plastic material in which abrasive paper and brushes are often moulded. Experience shows that abrasive paper and support brushes/retainer brushes are not worn at the same rate. This implies waste of material as it is necessary to discard the entire grinding element even though typically it is only the abrasive paper that is worn out.

Since on a circumferential face of a cylindric drum on an average there are between 30 and 60 grinding elements with abrasive paper and brushes, which by industrial use of the grinding or polishing tool is to be replaced regularly, the amount of grinding elements discarded constitutes a problem.

Furthermore, the shape of the element to be ground as well as the control of the cylindric drum during the grinding may imply uneven wear of the abrasive paper on the cylindric drum, so that some of the mounted grinding elements are to be exchanged more often.

There are different types of cylindric drums by which this problem is desired to be solved by mounting grinding elements which can be dismounted after which it is possible to replace the abrasive paper and/or brushes.

The disadvantage of the type of cylindric drums where the grinding element is mounted replaceable in rails which are mounted at the circumferential edge of the cylindric drum is that the rails may destroy the surface of the item to be ground if the rails accidentally touch the surface.

In a previously filed application, PCT/DK03/00238, the above problems are attempted to be solved by indicating different types of grinding elements that are adapted for accommodation in a recess in a surface of a cylindric drum, and where the abrasive paper and/or brushes are mounted directly in grooves in the retainer means of the grinding element, and where the abrasive paper and/or brushes are retained in the grooves by wedge action between the sidewalls of the recesses and the outer sidewalls of the retainer means of the grinding element, produced by the centrifugal force during rotation of the cylindric drum.

It has appeared to be a good idea to have grinding elements with replaceable abrasive paper and/or brushes since there is achieved great flexibility when using the cylindric drum when abrasive paper and/or brushes may readily be replaced according to need or according to the type of surface treatment.

However, a problem has arisen about the abrasive paper. It has been cumbersome to dispose a side part of the abrasive paper down into the groove in the desired position even if the grinding element has been dismounted from the cylindric drum. This is due to the abrasive paper not having sufficient rigidity so that it can be passed/drawn through the groove without bending, whereby the side part of the sandpaper e.g. forms a bead and jams in the groove.

This entails that the abrasive paper on succeeding grinding elements around a cylindric drum does not necessarily have the same length. With a fixed rotational speed on the cylindric drum, different peripheral speeds of the free ends of abrasive paper mounted in succeeding grinding elements are therefore attained, causing uneven grinding of an item.

SUMMARY OF THE INVENTION

Purpose of the Invention

It is therefore the purpose of the present invention to indicate a grinding element where the abrasive paper is easy to replace simultaneously with having a well-defined length from the centre of the cylindric drum to its free end.

This is achieved with a grinding element as described in the introduction of claim 1, and where the said grinding means, for accommodation in the groove, has a bottom part with a shape complementary to the groove.

DESCRIPTION OF THE INVENTION

In an embodiment of the present invention, the grinding element is provided with a grinding means constituted by a mounting means and sandpaper, where the mounting means has a connecting section to which the sandpaper is joined, and a socket section constituting the bottom part.

In order not to make the grinding system more expensive than previously or to necessitate investments in new types of cylindric drums and/or grinding elements, the mounting means is made so that it can be used together with grinding elements from existing grinding systems which are purchased from the same firm.

A permanent and secure retention of the mounting means in the groove for securing the sandpaper is achieved by the mounting means being made with a bottom part having a shape complementary to the groove for retaining the sandpaper.

In order to achieve a well-defined length of the abrasive paper from the centre of the cylindric drum to its free end, it is important that the mounting part fills out the groove and thereby provides that no outwards directed displacement of the mounting means can occur, or that the mounting means can move laterally in the groove. The only possibility of moving is the longitudinal displacement of the mounting means in the groove when the abrasive paper is to be replaced.

The abrasive paper is mounted on the connecting part of the mounting means before mounting the socket section of the mounting means in the groove, entailing that it is possible to fasten the abrasive paper in a desired position.

As the socket section of the mounting part is securely anchored in the retainer means of the grinding element, it is possible to retain the abrasive paper at a certain position on all mounting parts of the grinding elements of cylindric drum, implying that the length of the abrasive paper has a well-defined length from the centre of the cylindric drum to its free end, and that an optimal grinding of an item is achieved.

The length from the centre of a cylindric drum to the free end of the abrasive paper is therefore determined by the length of the abrasive paper only. This implies that if a cylindric drum with a large grinding diameter is desired, abrasive paper with great length is attached, or abrasive paper is attached farther out on the connecting section of the mounting means.

In the previously filed application PCT/DK03/00238 there is described a cylindric drum where the groove in the retainer means is made up of one or more parts, where a first part is a preferably straight groove, and where the second part either includes a cavetto or a preferably straight groove which is joined at an angle relative to the first part of the groove of the retainer means.

For mounting a abrasive paper with mounting means attached in the retainer means of existing grinding elements, the socket section of the mounting means is to be complementary with the shape of the groove for retaining sandpaper, and therefore the said socket section is designed with a first approximately straight part and a second part including one or more of the following parts: a straight second part angled in relation to the first straight part; a bead; and/or a number of projections.

This implies that

- mounting means with a socket section including a second part with an approximately straight part joined at one angle in relation to the first part fits a groove where the second part of the groove is joined at the same, previously mentioned angle in relation to the first part of the groove of the retainer means;
- mounting means with a socket section including a second part in the form of a bead fitting into the groove which ends in a cavetto;
- mounting means with a socket section including a second part with a number of projections that fit into groove with an approximately straight first part.

In one embodiment, projections on the socket section are designed so that they form wedges that are turned so as to allow to the socket section of the mounting means to be pressed down into the groove, but these projections will form retainers if pulling is performed on the mounting means before the grinding element is removed from the cylindric drum.

In the previously filed application PCT/DK03/00238 it is described how projections are disposed at the sides of the groove in the fastening means, which e.g. will imply that a mounting means with a number of projections may be mounted in such a groove, whereby the projections will engage and thereby prevent the mounting means from being pressed out of the groove.

In order to press the socket section of the mounting means down into the groove and simultaneously allow a certain bending of the mounting means when the abrasive paper is brought in contact with a surface, the mounting means is made of a flexible material, e.g. plastic or aluminium.

Particularly if the mounting means has projections, it is important that the socket section of the mounting means can yield without being deformed destructively at the mounting and dismounting of the mounting means in the groove of the retainer means. By making the mounting means of e.g. plastic or aluminium it becomes possible to e.g. mass produce it by moulding or extrusion, whereby it is ensured that the mounting means are approximately identical.

In an embodiment of the invention, the sandpaper is secured to the mounting means with glue and/or staples. The fastening is of high quality so that the sandpaper can endure to the blows and jerks arising when the grinding elements of the cylindric drum are brought in contact with the surface of an item, without being torn off the mounting element.

The sandpaper may furthermore be laid double so that the grinding means has two grinding sides implying that the grinding element may be mounted arbitrarily, or that the cylindric drum can rotate in both directions, and a grinding effect can still be achieved.

In an embodiment of the invention, the said fastening means in the outwards facing side furthermore includes a number of cutouts which are preferably designed as holes which are adapted for accommodating support brushes and/or retainer brushes, which the sandpaper then leans on at rotation of the cylindric drum, and thereby is achieved a greater rigidity of the sandpaper and a better dust removal.

These support brushes and/or retainer brushes are mounted exchangeably, and there is achieved a great flexibility in use of the cylindric drum when abrasive paper as well as support brushes and/or retainer brushes can be changed according to need or type of surface treatment.

The abrasive paper can e.g. be sandpaper for buffing wood, metal and the like, canvas and/or fabric polishing, or leather.

Support brushes and/or retainer brushes may e.g. be steel brushes, ondolon brushes or plastic brushes.

In order to ensure uniform fastening of the abrasive paper on the mounting means and thereby to achieve a well-defined length of the abrasive paper from the centre of the cylindric drum to the free end of the abrasive paper, the connecting part of the mounting means is provided with a marking, and the connecting part of the mounting means has one definite length.

The marking is used for rapid and easy marking during the production process to where the abrasive paper is to be placed during the fastening. This marking may be a transverse projection or cutout on the mounting means, a number of projections that are disposed transversely of the mounting means, a dimensional transition between the connecting part and the socket section of the mounting means and/or a coloured line.

Since the connecting part of the mounting means has one definite length, it is possible to automatically produce the marking during production at a certain spot, e.g. at the transition between the connecting part and socket section of the mounting means, since there will always be a connecting member of required length for fastening the abrasive paper.

In an alternative embodiment of the invention, the said fastening means is constituted by a centre fillet and an outer filled that encloses at least a lower part of the said centre fillet, and which at a side is designed with a longitudinal recess for accommodating a complementary longitudinal part of the said centre filled and a side member extending upwards in a cutout in a side of the centre fillet.

Since the outer fillet has a side member extending upwards in a cutout in a side of the said centre fillet, the outer fillet will be kept in position laterally, and together with the side member of the centre fillet, the side member will constitute the first of the outer sidewalls of the retainer means.

The outer fillet encloses the lower part of the said centre fillet and extends up along a side of the centre fillet and constitutes wholly or partly the second of the outer sidewalls of the retainer means.

The interspace between the outer fillet and the centre fillet constitutes the groove in the fastening means in which the bottom part of the grinding means can be mounted, implying that the grinding means may easily be exchanged without the fastening means being removed from the cylindric drum.

The bottom part of the grinding means may easily be fitted down into the outer fillet, so that it follows the shape of the outer fillet, after which the centre fillet can be pressed down into the outer fillet so that the longitudinal recess receives the complementary longitudinal part of the centre fillet, whereby the outer sidewalls of the fastening means are formed simultaneously with the grinding means is retained in the groove.

Alternatively, instead of a grinding means, which is constituted by a mounting means and a sandpaper, a grinding means is used which is constituted by a sandpaper with bent edge part that constitutes the said bottom part, whereby the sandpaper may be mounted in the grooved of the fastening means and thereby be retained during rotation of the cylindric drum by means of the squeezing force on the sidewalls of the fastening means.

This embodiment of the grinding means is particularly suited for use with a fastening means which is constituted by a centre fillet and an outer fillet, since it is possible to place the bent edge part of the sandpaper down into the outer fillet and subsequently to press the centre fillet in position down in the outer fillet.

The abrading side of the sandpaper will furthermore counteract the risk of the sandpaper becoming torn out of the groove in the fastening means.

The grinding element described above may be designed with either a fillet or a block that fits into the grinding system produced and sold by the firm Flex Trim A/S.

SHORT DESCRIPTION OF THE FIGURES

The invention is explained more closely in the following with reference to the drawings, where:

DETAILED DESCRIPTION OF THE INVENTION

Figure 1:
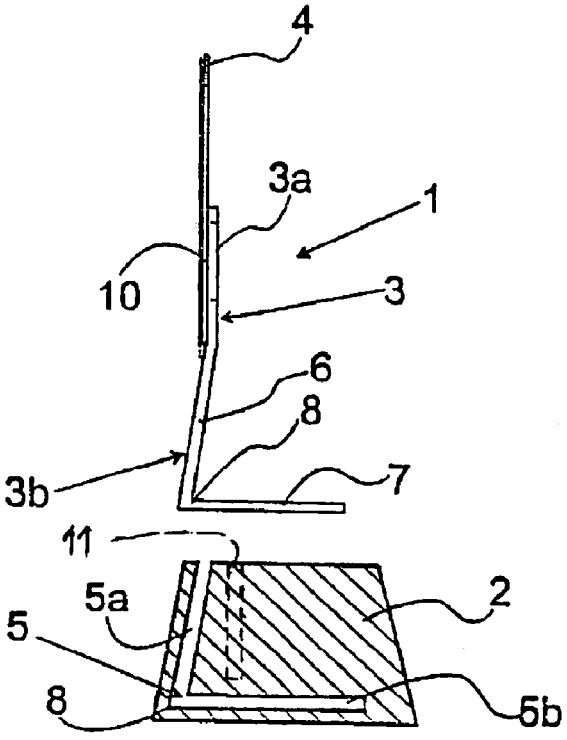
FIG. 1 shows a grinding element with a mounting means incl. abrasive paper and a fastening means and holes for accommodating support brushes and/or retainer brushes according to the invention.

On FIG. 1 is show a grinding element including a grinding means 1 and a retainer means 2 in which is provided a groove 5 that includes a first straight groove section 5*a* and a second straight groove section 5*b* which is connected at an angle 8 in relation to the first straight groove section 5*a*. Grinding means 1 is constituted by a sandpaper 4 and a mounting means 3 including a connecting section 3*a* and a socket section 3*b* which is made with a first straight part 6 and a second straight part 7 that are mutually connected at an angle 8. The socket section 3*b* of the mounting means 3 is complementary in shape with the groove 5 of the retainer means 2 and will therefore be entirely secured in the fastening means 2 when inserting the socket section 3*b* of the mounting means 3 in the groove 5 of the retainer means 2. At one side of the connecting section 3*a* of the mounting means 3 the abrasive paper 4 is secured with glue 10. Retainer means 2 includes a number of recesses in the outwards facing side designed as holes 11 for accommodating support brushes or retainer brushes.

Figure 2:
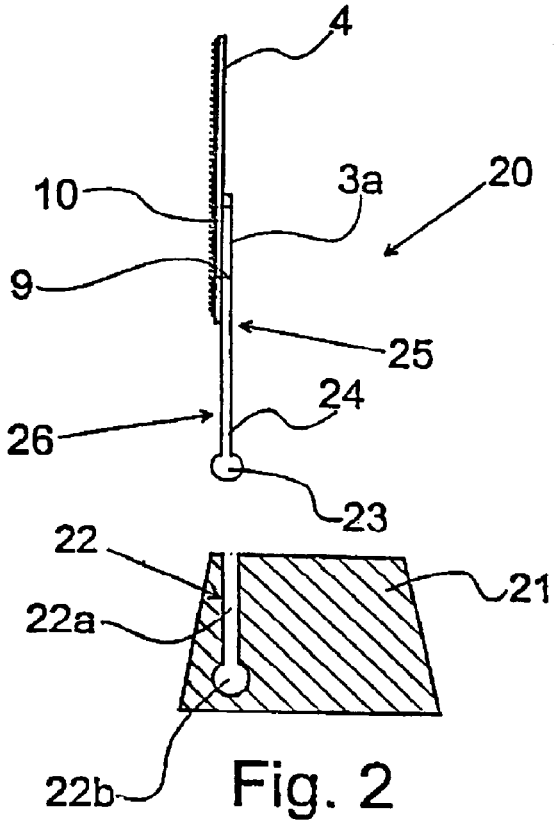
FIG. 2 shows an alternative grinding element with a mounting means including abrasive paper and a fastening means according to the invention.

On FIG. 2 a grinding element is shown, including a mounting means 25 and a retainer means 21 in which is provided a groove 22 that includes a first straight groove part 22*a* and a cavetto 22*b*. Grinding means 20 is constituted by sandpaper 4 and a mounting means 25 that includes a connecting section 3*a* and a socket section 26 which is made with a first straight part 24 and a bead 23. As the socket section 26 of the mounting means 25 has a shape complementing the groove 22 of the retainer mans 21, the mounting means 25 will be completely fixed in the retainer means 21 when inserting the socket section 26 of the mounting means 25 into the groove 22 of the retainer means 21. The sandpaper 4 is fastened on one side of the connecting section 3*a* of the mounting means 25 by staples 9 and glue 10.

Figure 3:
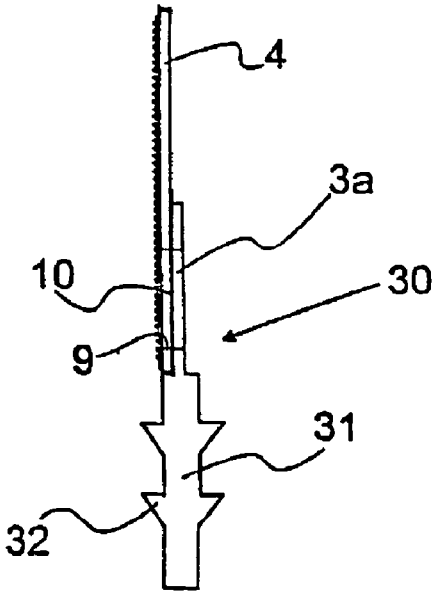
FIG. 3 shows a mounting means with abrasive paper according to the invention.

On FIG. 3 is shown an alternative grinding means 30 including a mounting means with a connecting section 3*a* and a socket section 31 on which are provided a number of projections 32 shaped as triangles which are turned so that they allow socket section 31 to be pressed down into a groove (not shown). Projections 32 will form retainers if the grinding means 30 is attempted to be pulled out of the groove (not shown). On one side of the connecting section 3*a* of the mounting means there is fastened an abrasive paper 4 with staples 9 and glue 10.

Figure 4:
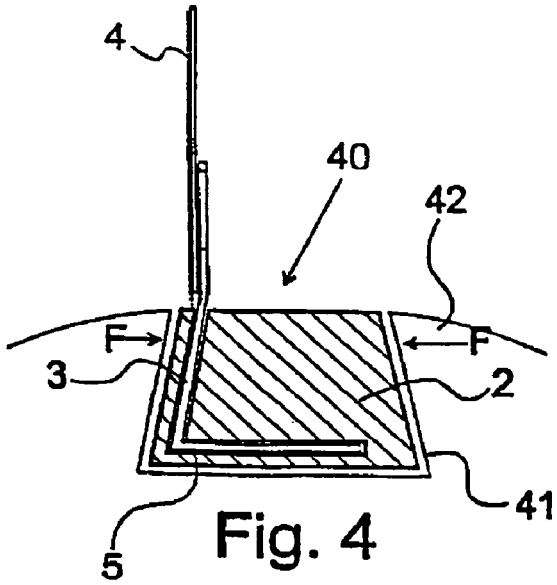
FIG. 4 shows a grinding element mounted in a cylindric drum.

On FIG. 4 is shown a grinding element 40 where the fastening means 2 is mounted in recess 41 in the cylindric drum 42. Due to the inclining sidewalls of both the fastening means 2 and the groove 41, by mounting and during rotation the mounting means 3 will be retained in the groove 5 in the fastening means 2 by means of a squeezing force F that presses the groove 5 together about the socket section of the mounting means 3.

Figure 5:
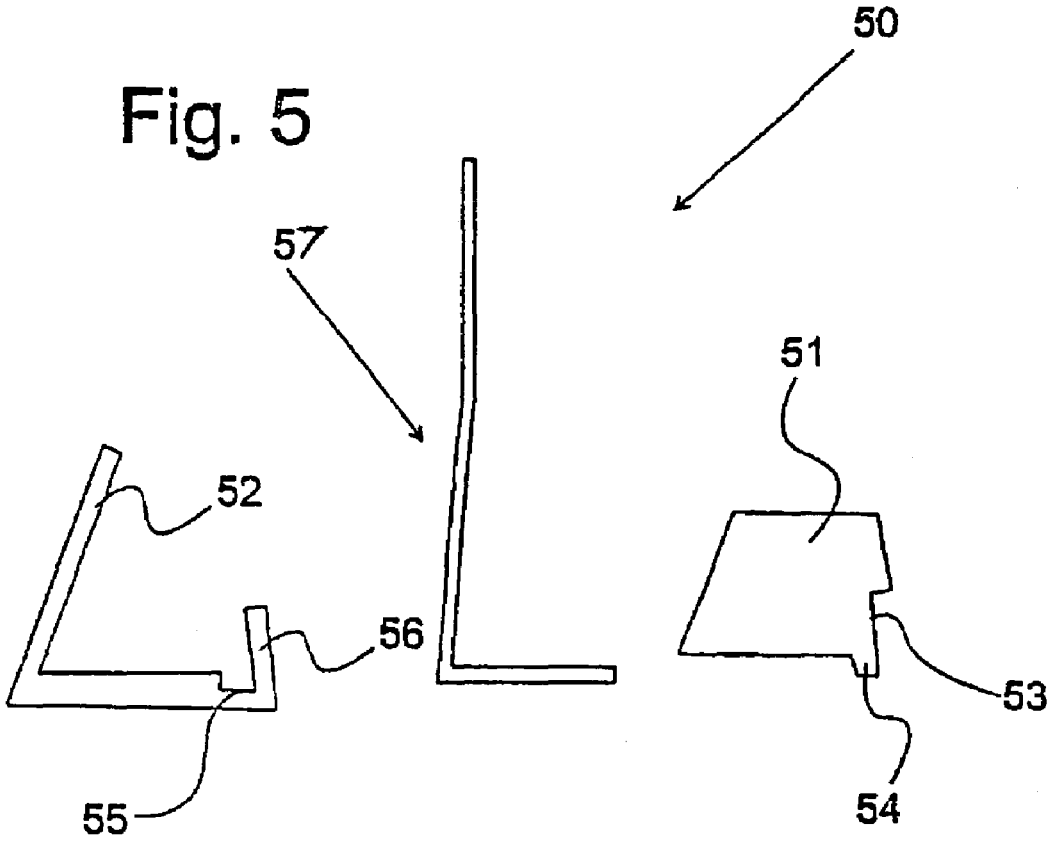
FIG. 5 shows parts for an alternative grinding element according to the invention.

On FIG. 5 is shown a grinding element 50 that includes a grinding means 57 and a fastening means constituted by a centre fillet 51 and an outer fillet 52. Centre fillet 51 has a side recess 53 and a longitudinal part 54 which is complementary to a longitudinal recess 55 in the outer fillet 52. The outer fillet 52 has a side member 56 which is arranged to extend upwards in side recess 53.

Figure 6:
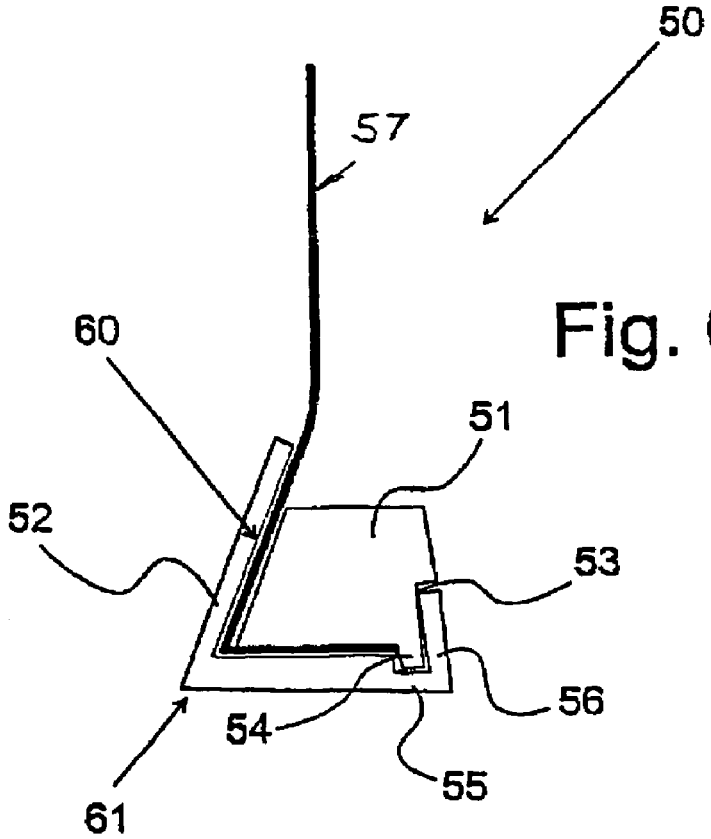
FIG. 6 shows the assembled alternative grinding element.

On FIG. 6 the grinding element 50 is shown assembled where grinding means 57 is fitted in the groove 60 which is provided between the Outer fillet 52 and the centre fillet 51. It is seen that the longitudinal recess 55 accommodates the longitudinal part 54 and thereby forms bottom in the groove 60. Furthermore, side member 56 is received in side cutout 53 whereby one outer sidewall of the fastening means 61 is constituted by the outer fillet 52, and the second outer sidewall is constituted by side member 56/centre fillet 51.

The invention claimed is:

1. Grinding element for mounting in a recess (41) in a surface of a cylindric drum (42) comprising a retainer means (2) with outer sidewalls that are complementary to sidewalls of the recess (41), where a squeezing force (F) on the sidewalls of the retainer means (2) arises in a situation of use by rotation of the cylindric drum (42), where the retainer means (2) includes at least one groove (5) for securing a grinding means (1), the groove (5) extending from an outwards facing side of the retainer means (2) and inwards and forming at least one elastic, pliable flap in the retainer means (2) between the said groove (5) and at least one of the outer sidewalls, wherein the squeezing force (F) bends the elastic, pliable flap inwards, thereby tightening the retainer means (2) around a mounting means (3), wherein the grinding means (1) for accommodation in the groove (5) in the retainer means (2) comprises the mounting means (3) having a socket section (3*b*) with a shape complementary to the groove (5) in the retainer means (2).

2. Grinding element according to claim 1, characterised in that grinding means (1) is constituted by a mounting means (3) and sandpaper (4), where the mounting means (3) has a connecting section (3*a*) to which the sandpaper (4) is joined, and the socket section (3*b*) constituting the bottom part.

3. Grinding element according to claim 2, characterised in that the socket section (3*b*) is designed with a first approximately straight part (6) and a second part including one or more of the following parts:

a straight second part (7) angled in relation to the first straight part;

a bead (23); and a number of projections (32).

4. Grinding element according to claim 2, characterised in that the mounting means (3) is made of a flexible material.

5. Grinding element according to claim 2, characterised in that the mounting means (3) is provided with a marking.

6. Grinding element according to claim 2, characterised in that the connecting section (3*a*) has one specific length.

7. Grinding element according to claims 2, characterised in that the sandpaper (4) is secured to the connecting section (3*a*) with glue (10) or staples (9).

8. Grinding element according to claim 2, characterised in that the grinding means is constituted by a sandpaper (57) with folded edge part constituting the bottom part.

9. Grinding element for mounting in a recess (41) in a surface of a cylindric drum (42) comprising a retainer means (2) with outer sidewalls that are complementary to sidewalls of the recess (41), where a squeezing force (F) on the sidewalls of the retainer means (2) arises in a situation of use by rotation of the cylindric drum (42), where the retainer means (2) includes at least one groove (5) for securing a grinding means (1), the groove (5) extending from an outwards facing side of the retainer means (2) and inwards and forming at least one elastic, pliable flap which is disposed between the said groove (5) and at least one of the outer sidewalls, wherein the grinding means (1) for accommodation in the groove (5) in the retainer means (2) comprises a mounting means (3) having a socket section (3*b*) with a shape complementary to the groove (5) in the retainer means (2) wherein the fastening means (61) is constituted by a centre fillet (51) and a outer fillet (52) that surrounds at least a lower part of the centre fillet (51), and which is designed at one side with a longitudinal recess (55) for accommodating a complementary longitudinal part (54) of the centre fillet (51) and a side part (56) extending upwards in a cutout (53) at one side of the centre fillet (51).

10. Grinding element according to claim 1, characterised in that the retainer means (2) in the outwards facing side further includes a number of recesses which are holes which are adapted for accommodating support brushes or retainer brushes.

* * * * *